US009219303B2

(12) United States Patent
Tsai et al.

(10) Patent No.: US 9,219,303 B2
(45) Date of Patent: Dec. 22, 2015

(54) EARPHONE ANTENNA, EARPHONE AND ELECTRONIC DEVICE EMPLOYING THE SAME

(75) Inventors: Chih-Yang Tsai, Taoyuan (TW); Hao-Ying Chang, Taoyuan (TW)

(73) Assignee: FIH (Hong Kong) Limited, Kowloon (HK)

( * ) Notice: Subject to any disclaimer, the term of this patent is extended or adjusted under 35 U.S.C. 154(b) by 1132 days.

(21) Appl. No.: 13/226,034

(22) Filed: Sep. 6, 2011

(65) Prior Publication Data

US 2012/0106770 A1 May 3, 2012

(30) Foreign Application Priority Data

Oct. 29, 2010 (TW) ..... 099137089 A

(51) Int. Cl.

| | |
|---|---|
| ***H01Q 1/04*** | (2006.01) |
| ***H01Q 1/44*** | (2006.01) |
| ***H01Q 9/30*** | (2006.01) |
| ***H01Q 21/28*** | (2006.01) |
| ***H01Q 21/30*** | (2006.01) |
| ***H04R 1/10*** | (2006.01) |

(52) U.S. Cl.

CPC . *H01Q 1/44* (2013.01); *H01Q 9/30* (2013.01); *H01Q 21/28* (2013.01); *H01Q 21/30* (2013.01); *H04R 1/1091* (2013.01)

(58) Field of Classification Search

CPC ..... H01Q 1/04
USPC ..... 343/718, 790, 745, 876, 904
See application file for complete search history.

(56) References Cited

U.S. PATENT DOCUMENTS

| | | | | |
|---|---|---|---|---|
| 7,373,169 | B2 * | 5/2008 | Yoshino | 455/550.1 |
| 2007/0105438 | A1 * | 5/2007 | Yoshino | 439/578 |
| 2007/0171134 | A1 * | 7/2007 | Yoshino et al. | 343/702 |
| 2008/0122711 | A1 * | 5/2008 | Kimura et al. | 343/745 |
| 2009/0015505 | A1 * | 1/2009 | Nagano et al. | 343/850 |
| 2010/0053005 | A1 * | 3/2010 | Mukai et al. | 343/720 |

FOREIGN PATENT DOCUMENTS

| | | | |
|---|---|---|---|
| CN | 101055936 | A | 10/2007 |
| EP | 1855351 | A1 | 11/2007 |

* cited by examiner

*Primary Examiner* — Huedung Mancuso
(74) *Attorney, Agent, or Firm* — Novak Druce Connolly Bove + Quigg LLP

(57) ABSTRACT

One or more antennas within an earphone arrangement used in an electronic device includes a plurality of coaxial cables, a first antenna unit, a second antenna unit, and a third antenna unit. The coaxial cables carry radio frequency (RF) signals of different frequency bands. The first antenna unit, the second antenna unit, and the third antenna unit each include a radiating member. Each radiating member can receive and transmit RF signals of at least one frequency band, and the coaxial cables carry the RF signals to the device for processing.

20 Claims, 9 Drawing Sheets

EARPHONE ANTENNA, EARPHONE AND ELECTRONIC DEVICE EMPLOYING THE SAME

BACKGROUND

1. Technical Field

The disclosure generally relates to antennas, and more particularly to an earphone antenna, and an earphone and an electronic device employing the same.

2. Description of the Related Art

Electronic devices, such as mobile phones and frequency modulation (FM) radios, can receive FM wireless signals at 76 MHz-108 MHz through an earphone that is also implemented as a FM antenna to receive the FM wireless signals. However, such electronic devices are usually further designed to receive television (TV) signals such as very high frequency (VHF) signals or ultra high frequency (UHF) signals. Thus, an antenna which is capable of receiving TV signals is usually integrated in the electronic device, which can increase the size and weight of the electronic devices.

Therefore, there is room for improvement within the art.

BRIEF DESCRIPTION OF THE DRAWINGS

Many aspects of an earphone antenna, an earphone and an electronic device employing the same can be better understood with reference to the following drawings. The components in the drawings are not necessarily drawn to scale, the emphasis instead being placed upon clearly illustrating the principles of the earphone antenna, earphone and electronic device employing the same. Moreover, in the drawings, like reference numerals designate corresponding parts throughout the several views. Wherever possible, the same reference numbers are used throughout the drawings to refer to the same or like elements of an embodiment.

DETAILED DESCRIPTION

Figure 1:
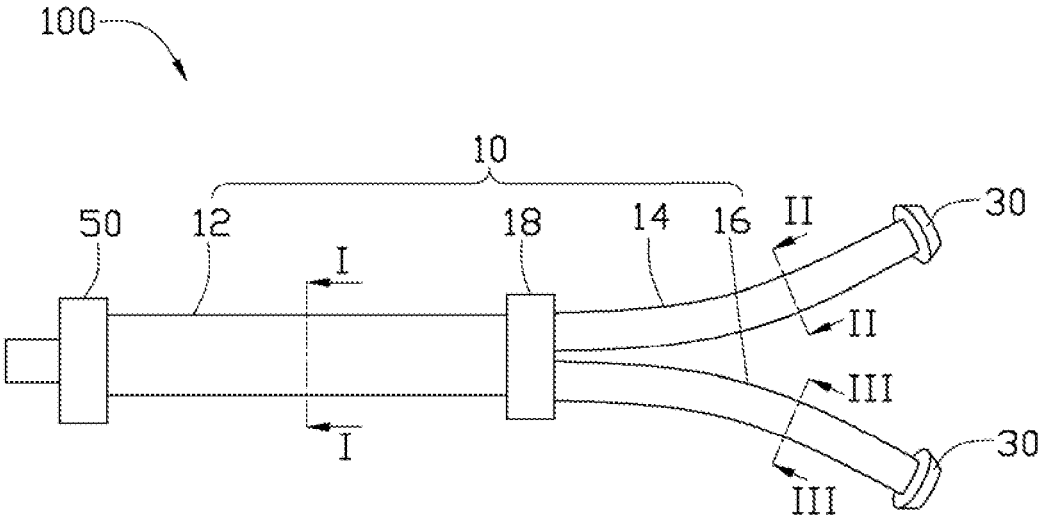
FIG. 1 is a schematic view of an earphone including an earphone antenna, according to an embodiment of the disclosure.

FIG. 1 shows a schematic view of an earphone 100 including an earphone antenna 10, according to an embodiment of the disclosure. The earphone 100 is electrically connected to an electronic device 200 (schematically shown in FIG. 5) to listen to audio signals, and the electronic device 200 can be a mobile phone.

Figure 5:
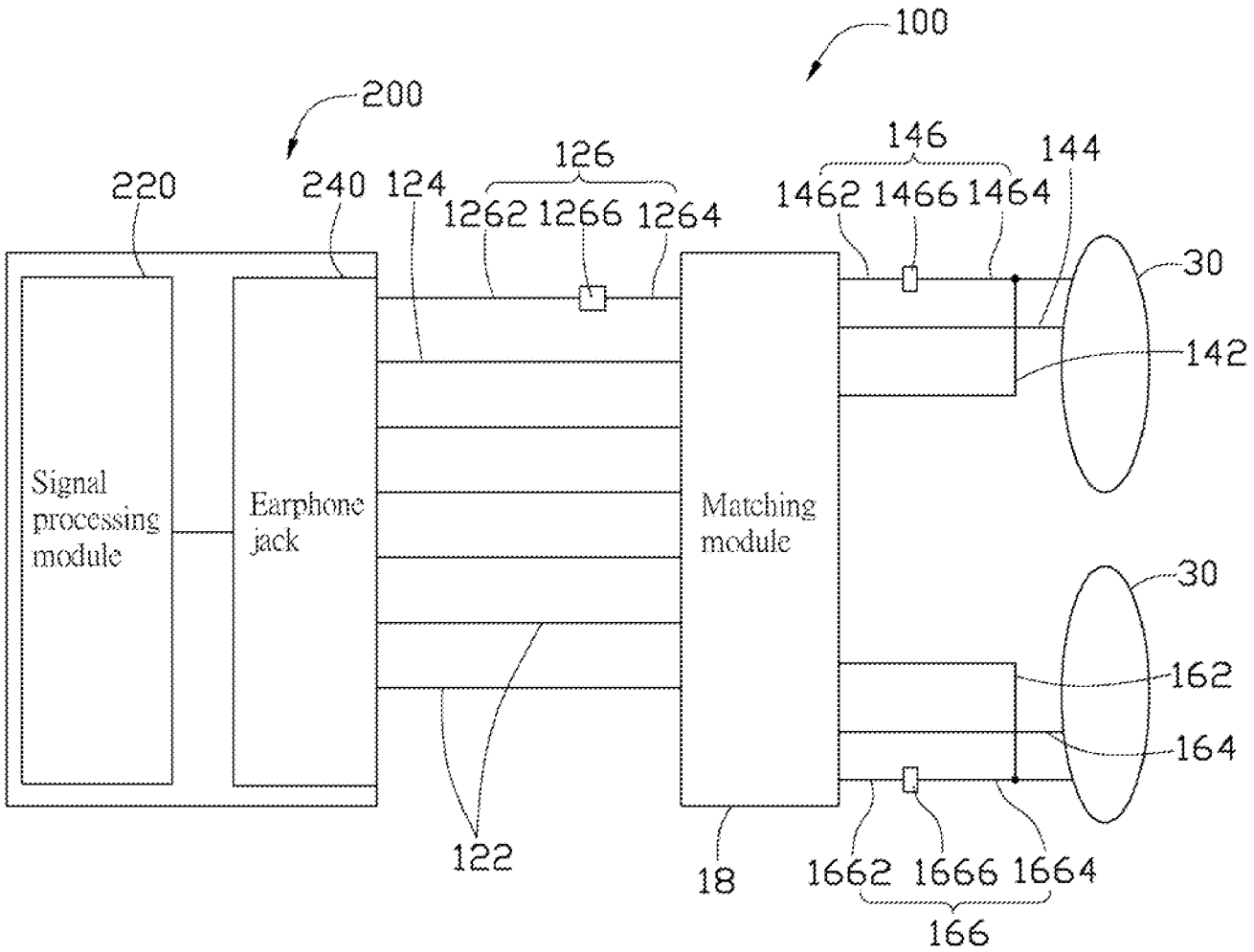
FIG. 5 is a block view of the earphone electrically connected to an electronic device of the disclosure.
Figure 6:
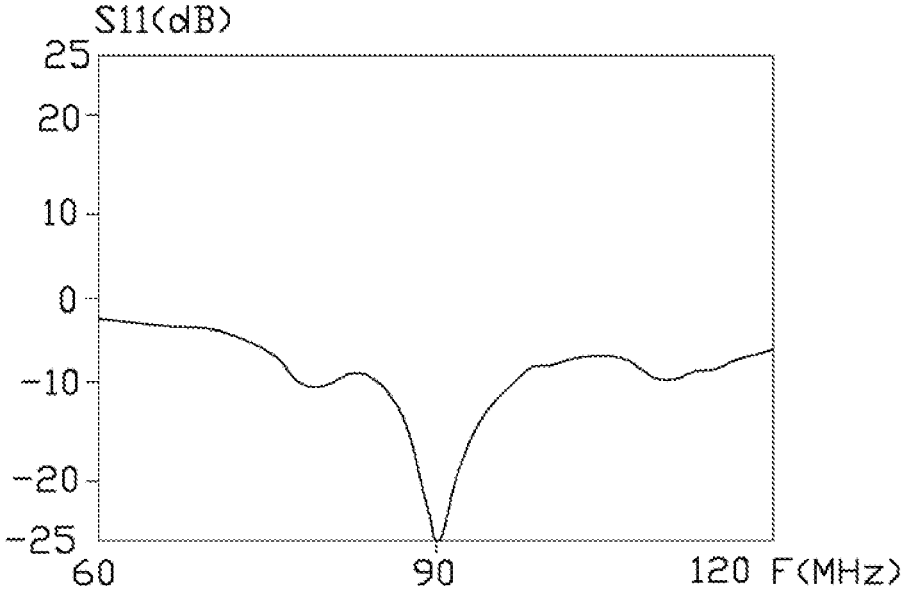
FIG. 6 is a graph of a simulated test result when the earphone is receiving DVB-UHF radio frequency (RF) signals, disclosing an insertion loss varying with frequencies.
Figure 7:
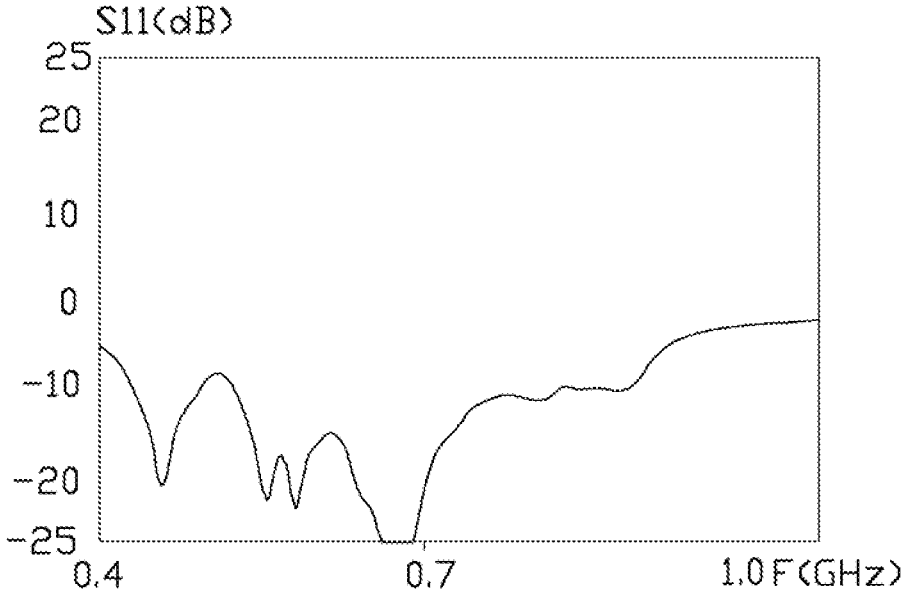
FIG. 7 is a graph of a simulated test result when the earphone is receiving FM RF signals, disclosing an insertion loss varying with frequencies.
Figure 8:
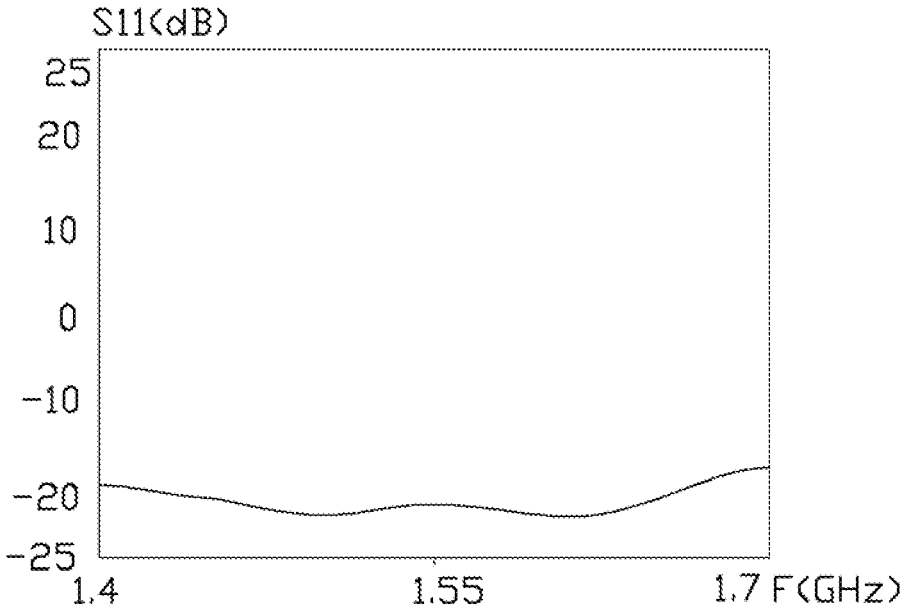
FIG. 8 is a graph of a simulated test result when the earphone is receiving GSM and DAB-L-BAND RF signals, disclosing an insertion loss varying with frequencies.
Figure 9:
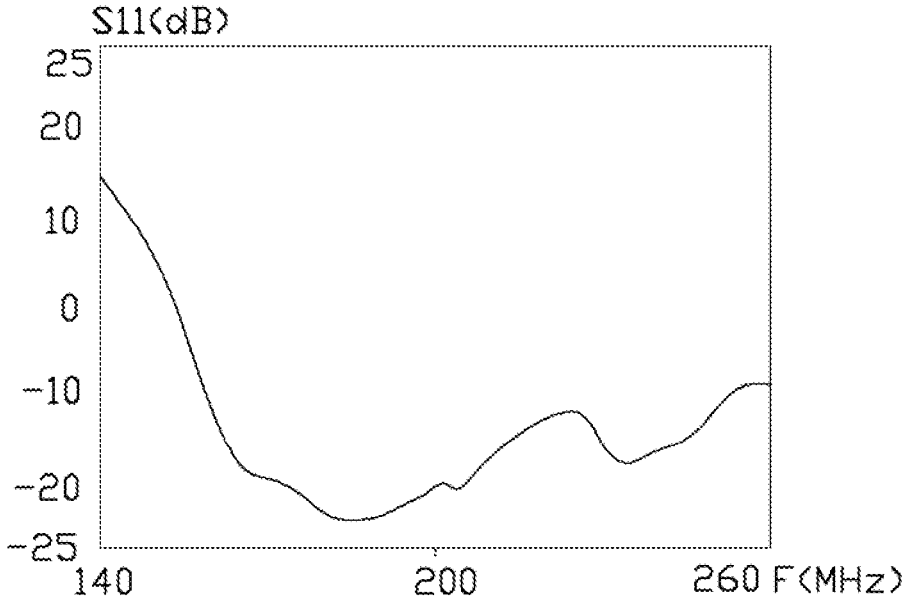
FIG. 9 is a graph of a simulated test result when the earphone is receiving DVB-VHF and DAB-III RF signals, disclosing an insertion loss varying with frequencies.

Referring to FIG. 5, the earphone 100 further includes loudspeakers 30 and an earphone plug 50. In this embodiment, the earphone antenna 10 is in the form of an earphone wire electrically connected between the loudspeakers 30 and the earphone plug 50, and is capable of delivering audio signals and receiving wireless signals. The loudspeakers 30 are used as left-channel/right-channel speakers to output sound in response to an electrical audio signal input. The earphone plug 50 is electrically connected to a corresponding earphone jack of the electronic device 200 to receive audio signals from a signal source such as an audio amplifier or an audio microchip.

The electronic device 200 includes a signal processing module 220 and an earphone jack 240 electrically connected to the signal processing module 220. The signal processing module 220 is capable of transforming and converting radio frequency (RF) signals from the earphone antenna 10 into corresponding audio signals.

The earphone jack 240 receives the processed audio signals from the signal processing module 220 and transmits the audio signals to the loudspeakers 30 through the earphone plug 50 and the earphone antenna 10. The earphone jack 240 is further capable of receiving RF signals from the earphone plug 50 and transmitting the RF signals to the signal processing module 220.

In this embodiment, the RF signal received by the earphone antenna 10 can be a frequency modulation (FM) signal whose RF range is about 88 MHz-108 MHz, a digital video broadcasting (DVB)-ultra high frequency (UHF) signal whose RF range is about 470 MHz-860 MHz, or a global positioning system (GPS) signal whose RF range is about 1570 MHz-1580 MHz. The RF signal can also be a DVB-very high frequency (VHF) signal whose RF range is about 170 MHz-240 MHz, or a digital audio broadcasting (DAB) signal whose RF range is about 1852 MHz-1892 MHz or 174 MHz-240 MHz.

The earphone antenna 10 includes a first antenna unit 12, a second antenna unit 14, a third antenna unit 16, and a matching module 18. The first antenna unit 12 is electrically connected between the earphone plug 50 and the matching module 18, and the second antenna unit 14 and the third antenna unit 16 are electrically connected to the first antenna unit 12 through the matching module 18.

Figure 2:
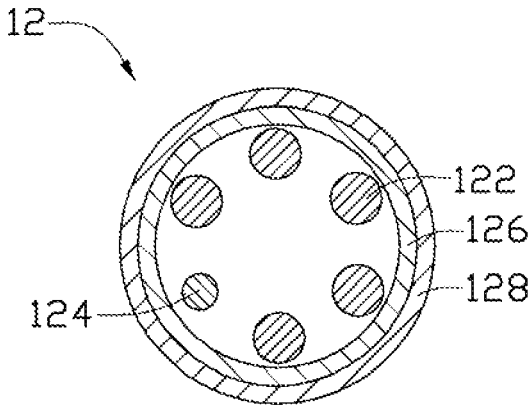
FIG. 2 is a cross-sectional view of the earphone antenna taken along line I-I of FIG. 1.

Referring to FIG. 2, the first antenna unit 12 includes a plurality of coaxial cables 122, an audio cable 124, a first radiating member 126, and an insulating sheath 128. The coaxial cables 122, the audio cable 124 and the first radiating member 126 are electrically connected to the earphone jack 240 of the electronic device 200 through the earphone plug 50.

In this embodiment, the number of the coaxial cables 122 is five, each of which is sized to have an effective length that allows for respectively receiving and carrying RF signals of the DVB-UHF band, the GPS band, the DVB-VHF band, the DAB-L band and the DAB-III band. The coaxial cables 122 are embedded in flexible insulating material and are insulated from each other to prevent mutual interference and to protect the signals against external electromagnetic interference. The audio cable 124 is separated from the coaxial cables 122 by the flexible insulating material, and is capable of carrying and delivering audio signals from the signal processing module 220 to the loudspeakers 30.

The insulating material, the coaxial cables 122 and the audio cable 124 are shielded and surrounded by the first radiating member 126. In this embodiment, the first radiating member 126 is made of a conductive material(s), such as copper or other metal to receive and transmit the RF signals. The first radiating member 126 includes a first radiating section 1262, a second radiating section 1264, and an isolation block 1266 connected between the first radiating section 1262 and the second radiating section 1264.

In this embodiment, the first radiating section 1262 is electrically connected to the earphone jack 240 through the earphone plug 50, and has an effective length that allows for the receiving and carrying of RF signals of the FM band and deliver those signals to the electronic device 200 through the earphone jack 240 and the earphone plug 50. The second radiating section 1264 is electrically connected to the earphone jack 240 through the matching module 18 and one of the coaxial cables 122, and the earphone plug 50, and has an effective length that allows for the receiving of DVB-UHF band signals. The first radiating section 1262 and the second radiating section 1264 are separated by the isolation block 1266 to prevent interference with each other, by means of a substantial (e.g. 50 mm) gap.

The isolation block 1266 is made from Manganese (Mn), Zinc (Zn) or other metal(s), and is located at the gap to prevent interference between the first radiating section 1262 and the second radiating section 1264. The insulating sheath 128 is made of plastic, and surrounds and shields the first radiating member 126 to protect the first radiating member 126.

Figure 3:
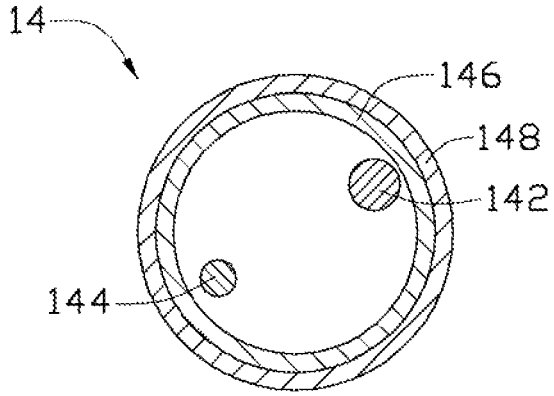
FIG. 3 is a cross-sectional view of the earphone antenna taken along line II-II of FIG. 1.

Referring to FIGS. 3 and 5, the second antenna unit 14 includes a coaxial cable 142, an audio cable 144, a second radiating member 146, and an insulating sheath 148. The coaxial cable 142 is embedded in the flexible insulating core and has an effective length that allows for carrying and transmitting RF signals. The audio cable 144 is electrically connected between the matching module 18 and one of the loudspeakers 30 to carry and deliver audio signals to the loudspeaker 30. The audio cable 144 is separated from the coaxial cable 142 by the flexible insulating material.

The insulating material, the coaxial cable 142 and the audio cable 144 are shielded and surrounded by the second radiating member 146. In this embodiment, the second radiating member 146 is made of conductive material(s), such as copper or other metal to receive, transmit and carry RF signals. The second radiating member 146 includes a third radiating section 1462, a fourth radiating section 1464, and an isolation block 1466 connected between the third radiating section 1462 and the fourth radiating section 1464.

In this embodiment, the third radiating section 1462 is electrically connected to the matching module 18 and has an effective length that allows for the receiving and carrying of GPS band signals. The fourth radiating section 1464 is electrically connected to one of the loudspeakers 30 and has an effective length that allows for the receiving and carrying of DVB-VHF band signals. The coaxial cable 142 is electrically connected between the matching module 18 and the fourth radiating section 1464. The third radiating section 1462 and the fourth radiating section 1464 are separated by the isolation block 1466 which creates a substantial gap of about 50 mm to prevent interference between the third radiating section 1462 and the fourth radiating section 1464.

The isolation block 1466 is made from Mn, Zn or other metal(s) and is located at the gap between the third radiating section 1462 and the fourth radiating section 1464. The insulating sheath 148 is made of plastic, and surrounds and shields the first radiating member 146 to protect the first radiating member 146.

Figure 4:
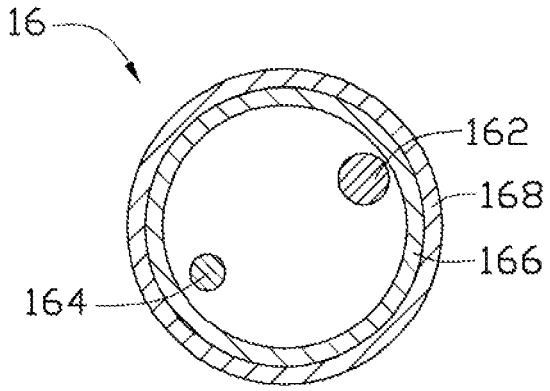
FIG. 4 is a cross-sectional view of the earphone antenna taken along line of FIG. 1.

Referring to FIGS. 4 and 5, the third antenna unit 16 includes a coaxial cable 162, an audio cable 164, a third radiating member 166, and an insulating sheath 148. The coaxial cable 162 is embedded in the flexible insulating material and functions as a conductor of RF signals, and has an effective length that allows for carrying RF signals. The audio cable 164 is electrically connected between the matching module 18 and the other loudspeaker 30 to carry and deliver audio signals to the loudspeaker 30. The audio cable 164 is separated from the coaxial cable 164 by the flexible insulating material.

The coaxial cable 162 and the audio cable 164 are surrounded and shielded by the third radiating member 166. In this embodiment, the third radiating member 166 is made of conductive material(s), such as copper, to receive and transmit RF signals. The third radiating member 166 includes a fifth radiating section 1662, a sixth radiating section 1664, and an isolation block 1666 connected between the fifth radiating section 1662 and the sixth radiating section 1664.

In this embodiment, the fifth radiating section 1662 is electrically connected to the matching module 18 and has an effective length that allows for the receiving and carrying of DAB-L band signals (e.g., 1852 MHz to 1892 MHz). The sixth radiating section 1664 is electrically connected to the other loudspeaker 30 and has an effective length that allows for the receiving and carrying of DAB-III band signals (e.g., 174 MHz to 240 MHz). The coaxial cable 162 is electrically connected between the matching module 18 and the sixth radiating section 1664. The fifth radiating section 1662 and the sixth radiating section 1664 are separated by the isolation block 1666 to prevent mutual interference, and the isolation block 1666 creates a substantial 50 mm gap between the fifth radiating section 1662 and the sixth radiating section 1664.

The isolation block 1666 is made from Mn, Zn or other metal(s), and is located at the gap between the third radiating section 1662 and the sixth radiating section 1664 to prevent interference between the fifth radiating section 1662 and the six radiating section 1664. The insulating sheath 168 is made of plastic and is capable of surrounding and shielding the third radiating member 166 to protect the third radiating member 166.

Referring to FIGS. 1 and 5, the matching module 18 is electrically connected to the first antenna unit 12, the second antenna unit 14 and the third antenna unit 16, to provide impedance matching and to filter out the noise from wireless signals. The matching module 18 is integrated with a plurality of conventional matching circuits (not shown) electrically connected to the coaxial cable 122, the audio cable 124 and the second radiating section 1264 of the first antenna unit 12, the coaxial cable 142, the audio cable 144 and the third radiating section 1462 of the second antenna unit 14, the coaxial cable 162, and the audio cable 164 and the fifth radiating section 1662 of the third antenna unit 16. Thus, any of the different signals can be carried by the radiating sections 1264, 1462, 1464, 1662 and 1664 to the electronic device 200 through the matching module 18 and the corresponding coaxial cable 122. The audio signals from the electronic device 200 may be carried and delivered to the loudspeakers 30 through the audio cable 124, the matching module 18, and the audio cables 144 and 164.

In use, the earphone 100 is electrically connected to, or is inserted into, the earphone jack 240 of the electronic device 200, and thereby the first radiating section 1262 has an electrical connection(s) with signal processing module 220 through the earphone jack 240. The second radiating section 1264, the third radiating section 1462, the fourth radiating section 1464, the fifth radiating section 1662 and the sixth radiating section 1664 each have an electrical connection(s) with the signal processing module 220 through the matching module 18 and the corresponding coaxial cables 122. Thus, the radiating sections 1262, 1264, 1462, 1464, 1662 and 1664 of the earphone antenna 10 can receive signals of the FM band, the DVB-UHF band, the GPS band, the DVB-VHF band and the DAB band, and carry and deliver those signals to the signal processing module 220 through different electrical paths. The signal processing module 220 then converts the signals into audio signals, and carries the audio signals to the loudspeakers 30 through the earphone jack 240, the audio cables, and matching module 18.

FIGS. 6-9 show simulated test graphs of the earphone antenna 10, disclosing insertion loss which varies with frequency. The horizontal axis of each test graph is expressed as the frequency, and the vertical axis of each test graph is expressed as the value of the insertion loss. When the earphone antenna 10 is working in any of the FM, the DVB-UHF, the GPS, the DVB-VHF, or the DAB bands, the corresponding insertion loss of each operating band is less than −5 dB, which meets the design requirements of the earphone antenna 10.

The band capabilities of the earphone antenna 10 are not limited to the six operating bands described, it can also deal with other frequency bands, such as WiFi and BLUETOOTH, which can be achieved by changing the physical dimensions such as the effective lengths of the radiating members. It is known to those skilled in the art that the effective length of an antenna radiating member is directly related to the frequency at which the antenna responds. In addition, any of the first antenna unit 12, the second antenna unit 14 and the third antenna unit 16 can include more than two radiating members.

In summary, the coaxial cables are surrounded and shielded by radiating members, and each radiating member is divided into different radiating sections that function as antennas to receive RF signals of many different frequency bands, which can reduce the size and weight of the electronic device 200 itself. Moreover, the integrity of the signals received is maintained by the use of isolation blocks between the radiating sections, therefore, signals of different bands are protected from external interference.

In the present specification and claims the word "a" or "an" preceding an element does not exclude the presence of a plurality of such elements. Further, the word "comprising" does not exclude the presence of other elements or steps than those listed.

It is to be understood, however, that even though numerous characteristics and advantages of the disclosure have been set forth in the foregoing description, together with details of the structure and function of the disclosure, the disclosure is illustrative only, and changes may be made in detail, especially in the matters of shape, size, and arrangement of parts within the principles of the disclosure to the full extent indicated by the broad general meaning of the terms in which the appended claims are expressed.

What is claimed is:

1. An earphone antenna, comprising:

a plurality of coaxial cables for transferring radio frequency (RF) signals of different frequency bands;

a first antenna unit comprising a first radiating member, the first radiating member for receiving, carrying and transmitting the RF signals;

a second antenna unit in electrical connection with the first antenna unit, the second antenna unit comprising a second radiating member; and a third antenna unit in electrical connection with the first antenna unit, the third antenna unit comprising a third radiating member, wherein any one of the first radiating member, the second radiating member and the third radiating member receives and transmits RF signal of different frequency bands, any one of the first radiating member, the second radiating member and the third radiating member surrounds at least one of the coaxial cables, and the coaxial cables transfer the RF signals from the corresponding first antenna unit, the second antenna unit and the third antenna unit;

wherein the first radiating member comprises a first radiating section, a second radiating section, and an isolation block, the first radiating section is separated from the second radiating section by a gap, and the isolation block is located at the gap to prevent interference between the first radiating section and the second radiating section.

2. The earphone antenna as claimed in claim 1, wherein the first radiating section and the second radiating section have an effective length that allows for receiving the RF signals of different frequency bands.

3. The earphone antenna as claimed in claim 2, wherein the second radiating member comprises a third radiating section, a fourth radiating section and an isolation block connected between the third radiating section and the fourth radiating section, the third radiating section and the fourth radiating section have an effective length that allows for receiving RF signals of different frequency bands, and the third radiating section and the fourth radiating section are separated by the isolation block and create a gap to prevent interference between the third radiating section and the fourth radiating section.

4. The earphone antenna as claimed in claim 3, wherein the third radiating member comprises a fifth radiating section, a sixth radiating section and an isolation block connected between the fifth radiating section and the sixth radiating section, the fifth radiating section and the sixth radiating section have an effective length that allows for receiving RF signals of different frequency bands, and the fifth radiating section and the sixth radiating section are separated by the isolation block and create a gap to prevent interference between the fifth radiating section and the sixth radiating section.

5. The earphone antenna as claimed in claim 1, wherein the isolation block is made of a metal.

6. The earphone antenna as claimed in claim 4, wherein each of the first antenna unit, the second antenna unit and the third antenna unit comprises an audio cable, the audio cable is separated from the corresponding coaxial cable and has an effective length that allows for the receiving of receiving and carrying audio signals, and the coaxial cable and the audio cable are surrounded and shielded by the corresponding radiating member.

7. The earphone antenna as claimed in claim 4, wherein the earphone antenna receives RF signals of frequency modulation band, digital video broadcasting (DVB)-ultra high frequency band, global positioning system band, DVB-very high frequency band, digital audio broadcasting (DAB)-L band and DAB-III band.

8. The earphone antenna as claimed in claim 1, further comprising a matching module, wherein the first antenna unit is electrically connected to the second antenna unit and the third antenna unit through the matching module, and the matching module provides impedance matching and filters out noise from the RF signals.

9. An earphone, comprising:

an earphone antenna for receiving and transmitting radio frequency (RF) signals, the earphone antenna comprising:

a plurality of coaxial cables for providing transmission lines for RF signals; and a plurality of radiating members electrically connected to the corresponding coaxial cables, wherein each radiating member receives and transmits the RF signals of at least one frequency band, and at least one of the coaxial cables is shielded and surrounded by any of the radiating members to carry and deliver the RF signals from the corresponding radiating member;

wherein each radiating member comprises two radiating sections and an isolation block electrically connected between the two radiating sections, and the radiating sections are separated by the isolation block and form a gap to prevent interference between the two radiating sections.

10. The earphone as claimed in claim 9, wherein each radiating section has an effective length that allows for the receiving and carrying RF signals of different frequency bands.

11. The earphone as claimed in claim 10, wherein the isolation block is made of metal, and is located at the gap between the radiating members to prevent interference between the two radiating sections of any of the radiating members.

12. The earphone as claimed in claim 10, wherein the earphone antenna further comprises an audio cable and an insulating sheath, the audio cable is separated from the coaxial cables and has an effective length that allows for the receiving of receiving, carrying and delivering audio signals, the coaxial cables and the audio cable are shielded and surrounded by the corresponding radiating member, and the radiating member is shielded and surrounded by the corresponding insulating sheath to protect the radiating member from electromagnetic interference.

13. The earphone as claimed in claim 12, further comprising two loudspeakers and an earphone plug, wherein the earphone antenna further comprises a matching module electrically connected to the coaxial cables, the audio cables and the radiating members to provide matching and filter out noise from the RF signals, and the earphone antenna is electrically connected between the loudspeakers and the earphone plug, the earphone plug electrically connects to an electronic device, the audio cables are electrically connected to the loudspeakers to carry and deliver the audio signals to the loudspeakers.

14. The earphone as claimed in claim 9, wherein the earphone antenna receives RF signals of frequency modulation band, digital video broadcasting-ultra high frequency band, global position system band, DVB-very high frequency band, digital audio broadcasting (DAB)-L band and DAB-III band.

15. An electronic device, comprising:

an earphone for carrying and delivering audio signals, the earphone comprising an earphone antenna for receiving and transmitting radio frequency (RF) signals, the earphone antenna comprising:

a plurality of coaxial cables for providing transmission paths for RF signals; and a plurality of radiating members in electrical connection with the corresponding coaxial cables, wherein each radiating member surrounds and shields at least one of the coaxial cables, any of the radiating members receives the RF signals of different frequency bands, and carries and transmits the RF signals through the corresponding coaxial cable;

wherein each radiating member comprises two radiating sections and an isolation block electrically connected between the two radiating sections, and the radiating sections are separated by the isolation block and form a gap to prevent interference between the two radiating sections.

16. The electronic device as claimed in claim 15, wherein each radiating section has an effective length that allows for the receiving and carrying the RF signals of different frequency bands.

17. The electronic device as claimed in claim 16, wherein the isolation block is made of metal, and is located at the gap between the radiating members to prevent interference between the two radiating sections of any of the radiating members.

18. The electronic device as claimed in claim 16, wherein the earphone antenna further comprises an audio cable and an insulating sheath, the audio cable is separated from the coaxial cables and has an effective length that allows for the receiving of receiving and carrying audio signals, the coaxial cables and the audio cable are shielded and surrounded by the corresponding radiating member, and the radiating member is embedded in the corresponding insulating sheath to protect the radiating member from electromagnetic interference.

19. The electronic device as claimed in claim 18, further a signal processing module for converting the RF signals from the earphone antenna into corresponding audio signals, wherein the earphone further comprises two loudspeakers, the earphone antenna further comprises a matching module electrically connected to the coaxial cables, the audio cables and the radiating members to provide matching and filter out noise from the RF signals, and the earphone antenna is electrically connected to the loudspeakers, the audio cables are electrically connected to the loudspeakers to carry and deliver the audio signals from the signal processing module to the loudspeakers.

20. The electronic device as claimed in claim 15, wherein the earphone antenna receives RF signals of frequency modulation band, digital video broadcasting (DVB)-ultra high frequency band, global position system band, DVB-very high frequency band, digital audio broadcasting (DAB)-L band and DAB-III band.

* * * * *